US005951272A

United States Patent [19]

Fukuhara et al.

[11] Patent Number: 5,951,272

[45] Date of Patent: Sep. 14, 1999

[54] SCROLL COMPRESSOR HAVING AN ANNULAR SEAL FOR A STATIONARY SCROLL PRESSURE RECEIVING SURFACE

[75] Inventors: Hiroyuki Fukuhara, Otsu; Shigeru Muramatsu, Kusatsu; Hidenobu Shintaku, Neyagawa; Noboru Iida, Kusatsu, all of Japan

[73] Assignee: Matsushita Electric Industrial Co., Ltd., Osaka, Japan

[21] Appl. No.: 08/796,382

[22] Filed: Feb. 6, 1997

[30] Foreign Application Priority Data

Feb. 9, 1996 [JP] Japan ..... 8-023579

[51] Int. Cl.[6] ..... F04C 18/04; F04C 27/00

[52] U.S. Cl. ..... 418/55.4; 418/55.5; 418/57

[58] Field of Search ..... 418/55.4, 55.5, 418/57

[56] References Cited

U.S. PATENT DOCUMENTS

| | | | |
|---|---|---|---|
| 3,874,827 | 4/1975 | Young | 418/55.5 |
| 4,877,382 | 10/1989 | Caillat et al. | 418/55.5 |
| 5,329,788 | 7/1994 | Caillat et al. | 418/55.5 |
| 5,346,376 | 9/1994 | Bookbinder et al. | 418/55.4 |
| 5,540,572 | 7/1996 | Park et al. | 418/55.5 |
| 5,674,061 | 10/1997 | Motegi et al. | 418/55.4 |

FOREIGN PATENT DOCUMENTS

| | | | |
|---|---|---|---|
| 63-309790 | 12/1988 | Japan | 418/55.5 |

*Primary Examiner*—John J. Vrablik
*Attorney, Agent, or Firm*—Stevens, Davis, Miller & Mosher, L.L.P.

[57] ABSTRACT

In a scroll compressor, a stationary scroll is pressed toward a movable scroll by a back pressure of a discharge fluid compressed by a compression mechanism, and wear powder, produced from an annular seal (which receives the pressure of the discharge fluid) as a result of precession of the stationary scroll, is arrested, thereby achieving the scroll compressor high in efficiency and reliability. A pressure-receiving surface for receiving a back pressure of the discharge fluid so as to press the stationary scroll toward the movable scroll is formed on that portion of the stationary scroll disposed around a communication port which is formed in the stationary scroll, and communicates with a discharge port. An annular seal is provided to form a seal between the stationary scroll and an upper frame around a region of communication between the communication port and the discharge port in such a manner as to satisfy a necessary annular sealing surface area, and a circumferential recess is provided on that side lower in pressure than this annular seal.

1 Claim, 4 Drawing Sheets

SCROLL COMPRESSOR HAVING AN ANNULAR SEAL FOR A STATIONARY SCROLL PRESSURE RECEIVING SURFACE

BACKGROUND OF THE INVENTION

1. Field of the Invention

This invention relates to a scroll compressor used in refrigeration air conditioning for business use and domestic use.

2. Related Art

Electrically-operated compressors, used in refrigeration air conditioning, are classified into those with a reciprocating compressing portion and those with a rotary compressing portion, and both have been used in the field of refrigeration air conditioning for business use and domestic use, and have grown up, taking advantage of their cost and features. Scroll-type compressors have been put into practical use, taking advantage of high-efficiency, low-noise and low-vibration features.

U.S. Pat. No. 3,874,827 discloses a construction in which a back pressure, produced by a discharge fluid, is exerted on a non-orbital, stationary scroll which is movable in an axial direction, and the stationary scroll is urged or pressed toward a movable scroll by this back pressure.

In such a construction, the sealing of several compression chambers, formed between the stationary and movable scrolls, can be enhanced, and the performance can be enhanced with a simple construction.

Generally, there has been used a construction in which wraps of stationary and movable scrolls are pressed against each other in a radial direction with a suitable force so as to reduce a leakage in the radial direction of the wraps. However, when the stationary scroll is so designed as to move in the axial direction, a force, tending to overturn the stationary scroll, is produced by the force, pressing the wrap of the movable scroll against the wrap of the stationary scroll, and a force of the compressed gas, so that the stationary scroll precesses. This precession occurs once per revolution, and therefore a vibration is applied to an annular seal member. One of inner and outer sides of the annular seal member contacts the precessing stationary scroll while the other side contacts an immovable stationary scroll support member, and the annular seal member separates a suction pressure portion, which applies a back pressure to the stationary scroll, from a discharge pressure portion. When a vibration is thus applied to the annular seal member, the annular seal member is liable to produce wear powder, and this wear powder is drawn into a compression mechanism portion, comprising the stationary scroll and the movable scroll, and is compressed, and flows into a refrigerating cycle connected to the compressor, and it is possible that this causes the clogging of filters in an expansion valve and other associated portions. In view of sealing properties, the annular seal member is, in many cases, made of a resin, and the amount of wear of the annular seal member will not adversely affect the reliability of the compressor. However, there is a high possibility that the wear powder is produced in an amount above an allowable dirt amount for the refrigerating cycle.

SUMMARY OF THE INVENTION

With the above problems in view, it is an object of this invention to provide a scroll compressor in which a recess is provided on a lower-pressure side of an annular seal, and with this construction wear powder, produced from the annular seal, is prevented from being fed to a refrigerating cycle, thereby achieving a high reliability of the scroll compressor.

According to one aspect of the present invention, there is provided a scroll compressor comprising:

a stationary scroll supported for movement in an axial direction; and a movable scroll supported for orbital movement, the movable scroll being engaged with the stationary scroll to form a compression chamber therebetween;

wherein the compression chamber is moved by the orbital movement from an outer peripheral side, drawing a fluid through a suction port, toward an inner peripheral side leading to a discharge port, so as to reduce the volume of the compression chamber, thereby effecting a compression operation and discharging the fluid to the discharge port;

wherein a pressure-receiving surface for receiving a back pressure of the discharge fluid so as to press the stationary scroll toward the movable scroll is formed on that portion of the stationary scroll disposed around a communication port which is formed in the stationary scroll, and communicates the compression chamber with the discharge port; and wherein an annular seal portion is provided to form a seal between the stationary scroll and a support member thereof around a region of communication between the communication port and the discharge port in such a manner as to satisfy a necessary annular sealing surface area, and a circumferential recess is provided in the back surface of a flange of the stationary scroll on that side lower in pressure than the annular seal portion.

In the above scroll compressor, preferably, there is provided a projection engaged in the recess in such a manner that a gap between the projection and the recess is larger than a gap between the stationary scroll and the stationary scroll support member.

According to another aspect of the invention, there is provided a scroll compressor comprising:

a stationary scroll supported for movement in an axial direction; and a movable scroll supported for orbital movement, the movable scroll being engaged with the stationary scroll to form a compression chamber therebetween;

wherein the compression chamber is moved by the orbital movement from an outer peripheral side, drawing a fluid through a suction port, toward an inner peripheral side leading to a discharge port, so as to reduce the volume of the compression chamber, thereby effecting a compression operation and discharging the fluid to the discharge port;

wherein a pressure-receiving surface for receiving a back pressure of the discharge fluid so as to press the stationary scroll toward the movable scroll is formed on that portion of the stationary scroll disposed around a communication port which is formed in the stationary scroll, and communicates the compression chamber with the discharge port; and wherein an annular seal portion is provided to form a seal between the stationary scroll and a support member thereof around a region of communication between the communication port and the discharge port in such a manner as to satisfy a necessary annular sealing surface area, and an annular seal member is provided on that side lower in pressure than the annular seal portion.

Thus, in the present invention, the recess is provided on the lower-pressure side of the annular seal, and wear powder, produced from the annular seal when the annular seal is worn as a result of precession of the stationary scroll, moves toward the lower-pressure side because of a pressure difference between the inner and outer sides of the annular seal, and this wear powder is stored in the recess. Therefore, there will not be encountered a situation in which the wear powder of the annular seal is drawn into the compression mechanism, and is compressed there, and is discharged therefrom to a refrigerating cycle.

There can be provided the projection engaged in the recess in such a manner that the gap between the projection and the recess is larger than the gap between the stationary scroll and the stationary scroll support member. With this construction, wear powder of the annular seal is stored in the recess, and further the projection prevents the wear power from moving toward the outer peripheral side, and therefore there will not be encountered a situation in which the wear powder of the annular seal is drawn into the compression mechanism, and is compressed there, and is discharged therefrom to the refrigerating cycle. Further, the annular seal member can be provided on the lower-pressure side of the annular seal, and with this construction there will not be encountered a situation in which the wear powder of the annular seal, separating the higher pressure and the lower pressure from each other, is drawn into the compression mechanism, and is compressed there, and is discharged therefrom to the refrigerating cycle.

DESCRIPTION OF THE PREFERRED EMBODIMENTS

The present invention will now be described with reference to FIGS. 1 to 4.

First Embodiment

Figure 1:
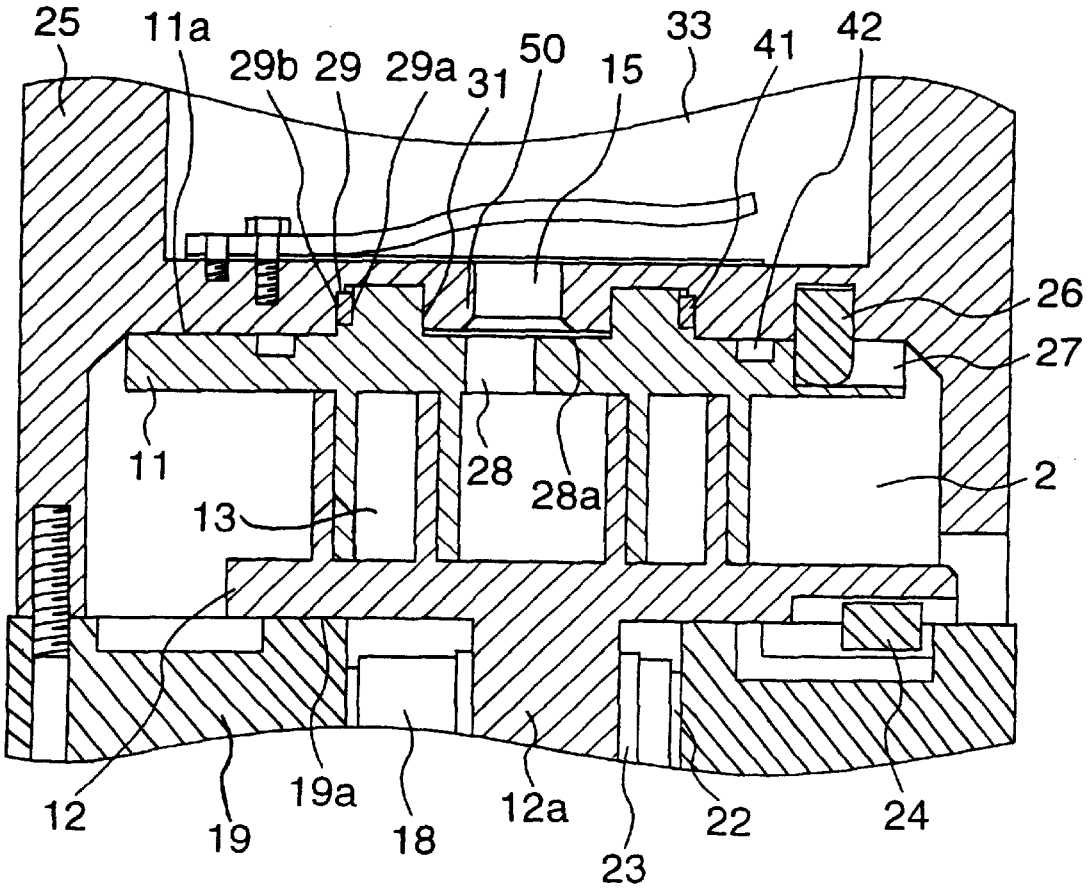
FIG. 1 is a cross-sectional view of a first embodiment of a scroll compressor of the present invention.
Figure 4:
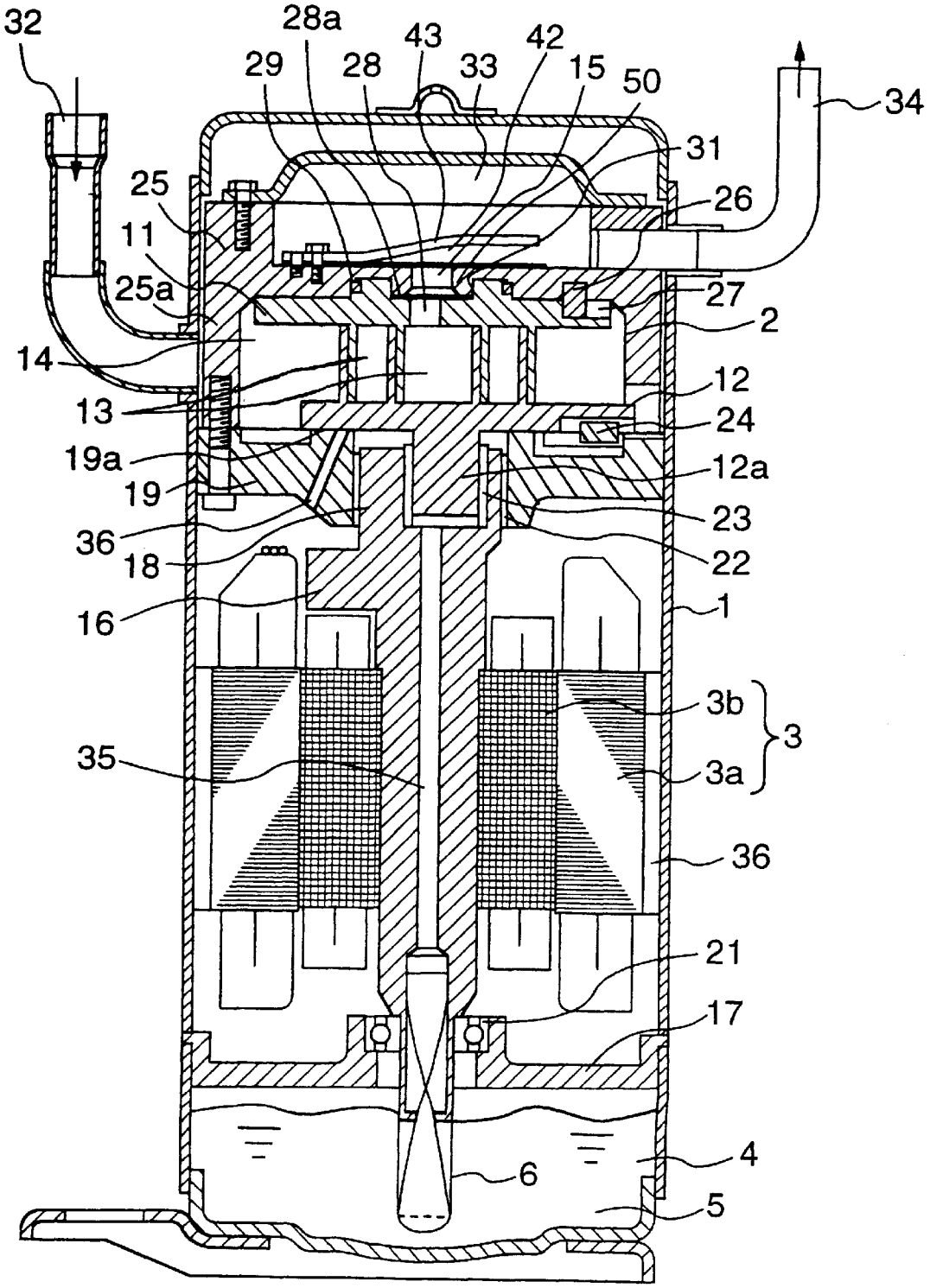
PRIOR ART FIG.4
FIG. 4 is a cross-sectional view showing a compression mechanism portion of a conventional scroll compressor.

FIG. 1 shows a first embodiment of the present invention. This embodiment is directed to a vertical-type scroll compressor used in refrigeration air conditioning, and FIG. 4 shows an overall construction of a conventional scroll compressor.

Referring to the conventional scroll compressor, a scroll-type compression mechanism 2 is provided at an upper portion of the interior of a sealed container 1, and an electric motor 3 for driving the compression mechanism 2 is provided at an intermediate portion of the interior of the sealed container 1, and an oil reservoir 5 for holding oil (lubricant) 4, as well as an oil guide 6 for feeding the oil 4 from the oil reservoir 5 to parts to be lubricated, is provided at a lower portion of the interior of the sealed container 1. The oil guide 6 may be replaced by another type of pump.

The compression mechanism 2 comprises a stationary scroll 11 and a movable scroll 12 engaged with each other as in a conventional construction, and when the movable scroll 12 is driven to be revolved (that is, to make an orbital motion), several compression chambers 13, formed between the two scrolls 11 and 12, are moved from an outer peripheral side, leading to a suction (or intake) port 14, toward an inner peripheral side leading to a discharge port 15, so as to reduce the volume of these chambers, thereby effecting the compression.

A support structure and a drive structure for these scrolls, as well as a guide structure for a fluid which is drawn, compressed and discharged, can be of any suitable construction. In this embodiment, the compression mechanism 2 is of the vertically-installed type, and the upper-side stationary scroll 11 is engaged with the lower-side movable scroll 12. The electric motor 3 comprises an annular stator 3*a* fixedly secured to the inner side of the sealed container 1, and a rotor 3*b* provided inside the stator 3*a*, and a crankshaft 16 is fixedly secured to the rotor 3*b* so as to revolve the movable scroll 12 in the compression mechanism 2.

A lower end portion of the crankshaft 16 is borne by a lower frame 17 within the sealed container 1, and a main shaft 18, formed at an upper end portion of the crankshaft 16, is borne by an intermediate frame 19 within the sealed container 1. A roller bearing 21 for bearing the lower end portion of the crankshaft 16 is mounted on the lower frame 17, and a slide bearing 22 for bearing the main shaft 18 is provided on the intermediate frame 19. However, these bearing structures may be replaced by other suitable ones.

The movable scroll 12 is supported from the lower side by a thrust bearing portion 19*a* provided on an upper surface of the intermediate frame 19, and a follower shaft 12*a* of the movable scroll 12 is fitted in an eccentric bearing 23 formed on the crankshaft 16. With this construction, the movable scroll 12 is revolved by the rotation of the crankshaft 16. An Oldham ring 24 is provided between the movable scroll 12 and the intermediate frame 19 for making the movable scroll 12 orbit when the movable scroll 12 revolves.

The stationary scroll 11 is supported by an upper frame 25, which is disposed above the stationary scroll 11 and fixedly mounted within the sealed container 1, so as to move in the axial direction through a cylindrical slide portion 31. As shown in FIGS. 1 to 4, a pin 26, projecting from the upper frame 25, is fitted in a radially-extending recess 27 formed in the stationary scroll 11, thereby preventing the rotation of the stationary scroll 11.

The stationary scroll 11 has a communication port 28 formed through a substantially central portion thereof, and the compression chamber 13 communicates with the discharge port 15 through this communication port 28. A pressure-receiving surface 28*a* for receiving a back pressure of the discharge fluid is formed on that portion of the upper surface of the stationary scroll 11 disposed around the communication port 28, and the stationary scroll 11 is pressed toward the movable scroll 12 by the back pressure acting on this pressure-receiving surface 28*a*, so that the sealing of the compression chambers, formed between the two scrolls 11 and 12, is ensured with this simple construction. An annular seal 29 forms a seal between the stationary scroll 11 and the upper frame 25 around a region of communication between the communication port 28 and the discharge port 15, thereby preventing the discharge cooling medium from leaking at this communication region.

The compressor of this embodiment is the scroll compressor for refrigeration air conditioning, and therefore the fluid, which is drawn into and compressed by the compression mechanism 2, and is discharged therefrom, is a cooling medium, and the oil 4 is compatible with this cooling medium.

A gas suction pipe 32 is connected to the suction port 14, and a gas discharge pipe 34 is connected to the discharge port 15 via a discharge chamber 33 provided in the sealed container 1.

The oil guide 6 is mounted on the lower end of the crankshaft 16, and is driven together with the compression mechanism 2 to feed the oil 4 from the oil reservoir 5 into an oil passage 35, formed longitudinally in the crankshaft 16, to first supply the oil 4 to the eccentric bearing 23. Part of the oil 4, supplied to the eccentric bearing 23, is further supplied to the slide bearing 22 and the compression mechanism 2 through gaps, while the remainder is returned through a passage 36 to the oil reservoir 5 provided at the lower end portion of the sealed container 1.

The cooling medium, which is drawn into and compressed by the compression mechanism 2, and is discharged therefrom, contacts the oil 4 in the compression mechanism 2 to carry the oil 4, and brings the oil 4 to details, thereby effecting the necessary lubrication.

As shown in FIG. 1, the annular seal 29 comprises an annular seal member 41 interposed between opposed cylindrical slide surfaces 29*a* and 29*b* formed respectively on the stationary scroll and the upper frame 25, and the annular seal 29 is so designed as to satisfy a sealing surface area necessary for preventing a leakage of the high-pressure discharge fluid (cooling medium). A circumferential recess 42 is formed in the stationary scroll 11 on the lower-pressure side of the annular seal 29. In this embodiment, although the circumferential recess 42 is formed in the stationary scroll 11, it may be formed in the upper frame 25, or two such circumferential recesses may be formed in the stationary scroll 11 and the upper frame 25, respectively.

With this construction, when the stationary scroll 11 precesses, the annular seal member 41 is worn to produce wear powder, and this wear powder is stored in the circumferential recess 42, and is prevented from moving radially outwardly of the circumferential recess 42. Therefore, there will not be encountered a situation in which this wear powder is drawn into the compression mechanism from the outer peripheral portion of the stationary scroll 11, and is compressed there, and is discharged therefrom to a refrigerating cycle via the gas discharge pipe 34, and therefore there can be provided the compressor which is high in reliability and efficiency.

Second Embodiment

Figure 2:
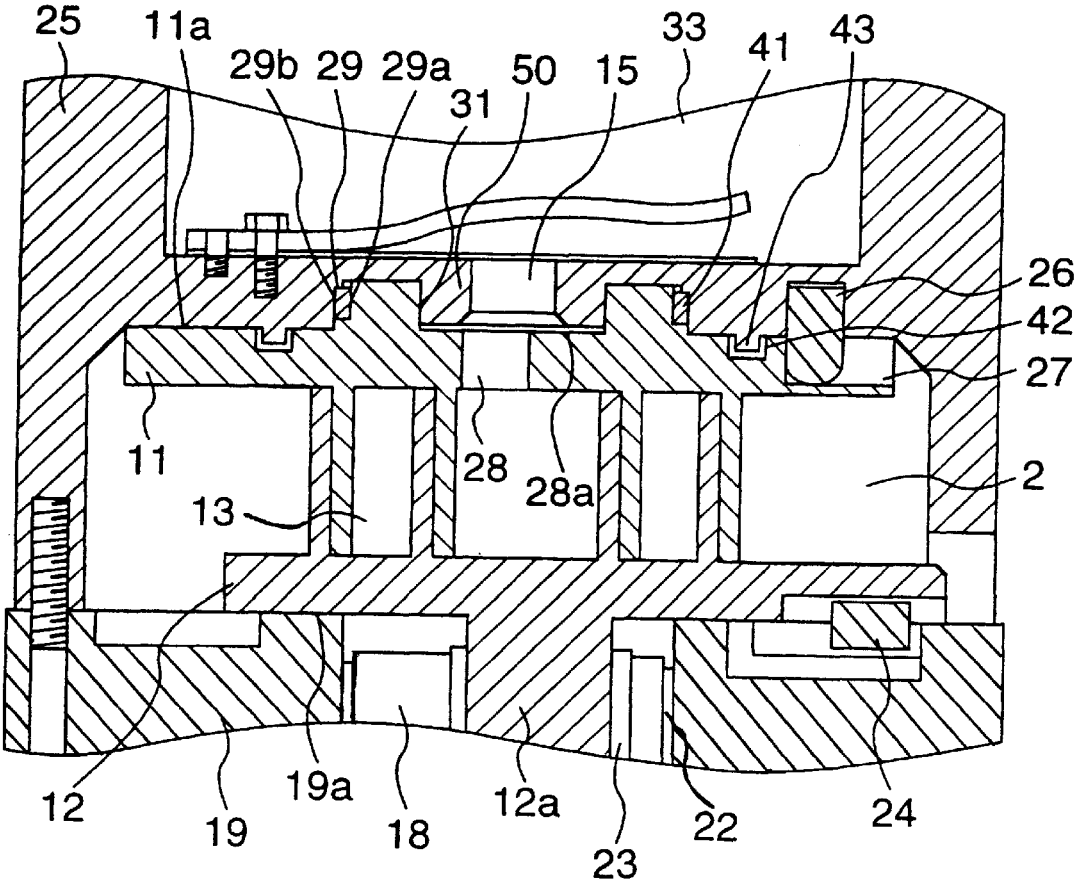
FIG. 2 is a cross-sectional view showing a compression mechanism portion of a scroll compressor according to a second embodiment of the invention.

FIG. 2 shows a second embodiment of the present invention. A circumferential projection (convex portion) 43 is formed on an upper frame 25, and is engaged or received in a circumferential recess 42 formed in a stationary scroll 11 on a lower-pressure side of an annular seal member 41, and a gap between the circumferential recess 42 and the circumferential projection 43 is larger than a gap between the stationary scroll 11 and a stationary scroll support member 50 of the upper frame 25. Such a circumferential recess may be formed in the upper frame 25, and such a circumferential projection may be formed on the stationary scroll 11.

With this construction, when the stationary scroll 11 precesses, the annular seal member 41 is worn to produce wear powder, and this wear powder is stored in the circumferential recess 42, and is prevented by the circumferential projection 43, formed on the upper frame 25, from moving, and therefore this wear powder is prevented from moving to the outside (that is, the lower-pressure side) of the circumferential recess 42. Therefore, there will not be encountered a situation in which this wear powder is drawn into the compression mechanism from the outer peripheral portion of the stationary scroll 11, and is compressed there, and is discharged therefrom to a refrigerating cycle via the gas discharge pipe 34, and therefore there can be provided the compressor which is high in reliability and efficiency.

Third Embodiment

Figure 3:
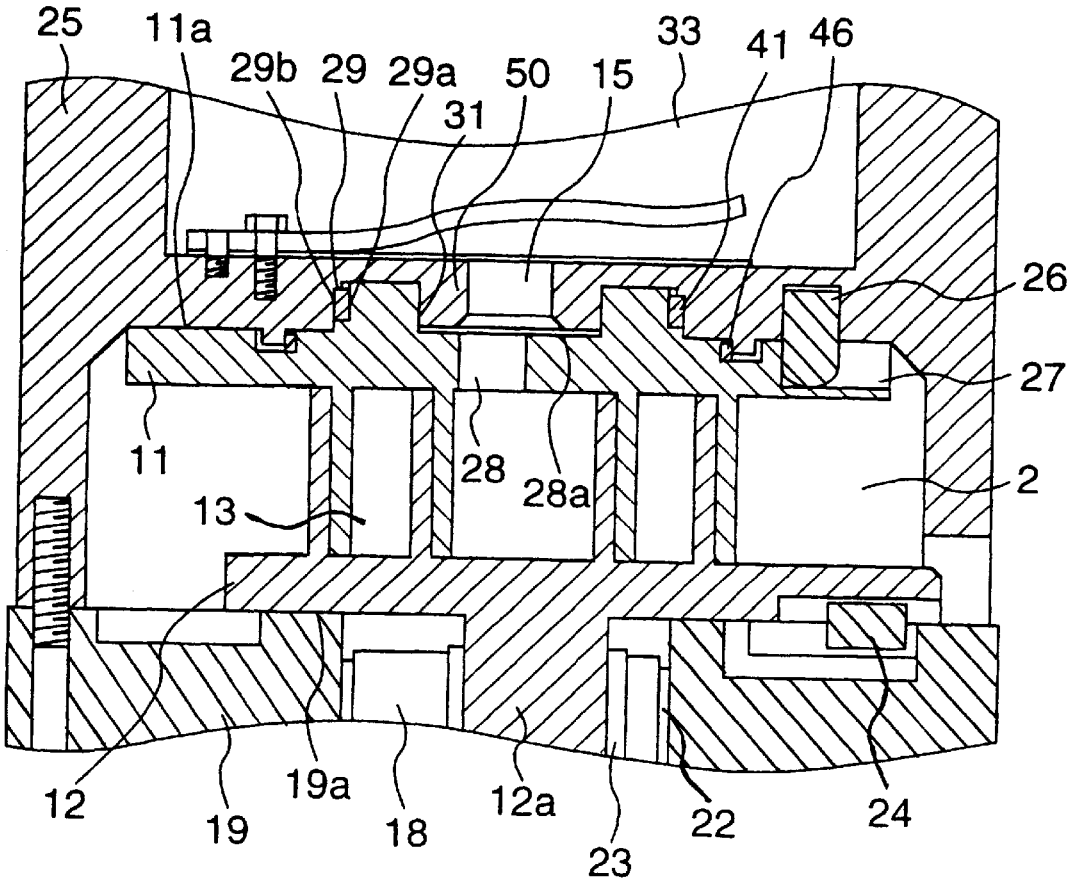
FIG. 3 is a cross-sectional view showing a compression mechanism portion of a scroll compressor according to a third embodiment of the invention.

FIG. 3 shows a third embodiment of the present invention. In this embodiment, a circumferential seal member 46 is provided on a lower-pressure side of an annular seal member 41. With this construction, when a stationary scroll 11 precesses, the annular seal member 41 is worn to produce wear powder, and this wear powder is prevented by the circumferential seal member 46 from moving to the lower-pressure side. Therefore, there will not be encountered a situation in which this wear powder is drawn into the compression mechanism from the outer peripheral portion of the stationary scroll 11, and is compressed there, and is discharged therefrom to a refrigerating cycle via the gas discharge pipe 34; and therefore there can be provided the compressor which is high in reliability and efficiency.

In FIGS. 2 and 3, the other construction is substantially the same as that of the first embodiment, and therefore identical members or parts are designated by identical reference numerals, respectively, and repeated explanation thereof is omitted.

As described above, according to the main features of the scroll compressor of the present invention, the stationary scroll is movable in the axial direction relative to the stationary scroll support portion through guidance of the cylindrical slide portion, and the pressure-receiving surface, provided around the communication port communicating the compression chamber with the discharge port, receives a back pressure of the discharge fluid so as to press the stationary scroll toward the movable scroll, thereby enhancing the sealing of the compression chambers. And besides, the annular seal portion, having the necessary sealing surface area, forms a seal between the stationary scroll and the support member thereof around the region of communication between the communication port and the discharge port, thereby positively preventing a leakage of the high-pressure discharge fluid, and the circumferential recess is provided on the lower-pressure side of the annular seal portion, so that wear powder, produced from the annular seal as a result of precession of the stationary scroll, can be stored in this circumferential recess, and therefore there will not be encountered a situation in which the wear powder of the annular seal is drawn into the compression mechanism, and is compressed there, and is discharged therefrom to the refrigerating cycle. Therefore, there can be achieved the scroll compressor which is high in efficiency and reliability.

There is provided the projection engaged in the recess in such a manner that the gap between the projection and the recess is larger than the gap between the stationary scroll and the stationary scroll support member. With this construction, wear powder, produced from the annular seal as a result of precession of the stationary scroll, is arrested, and therefore there will not be encountered a situation in which the wear powder of the annular seal is drawn into the compression mechanism, and is compressed there, and is discharged therefrom to the refrigerating cycle. Therefore, there can be achieved the scroll compressor which is high in efficiency and reliability.

According to the main features of the scroll compressor of the present invention, the stationary scroll is movable in the axial direction relative to the stationary scroll support portion through guidance of the cylindrical slide portion, and the pressure-receiving surface, provided around the communication port communicating the compression chamber with the discharge port, receives a back pressure of the discharge fluid so as to press the stationary scroll toward the movable scroll, thereby enhancing the sealing of the compression chambers. And besides, the annular seal portion, having the necessary sealing surface area, forms a seal between the stationary scroll and the support member thereof around the region of communication between the communication port and the discharge port, thereby positively preventing a leakage of the high-pressure discharge fluid, and the circumferential seal member is provided on the lower-pressure side of the annular seal, so that wear powder, produced from the annular seal as a result of precession of the stationary scroll, can be arrested, and therefore there will not be encountered a situation in which the wear powder of the annular seal is drawn into the compression mechanism, and is compressed there, and is discharged therefrom to the refrigerating cycle. Therefore, there can be achieved the scroll compressor which is high in efficiency and reliability.

What is claimed is:

1. A scroll compressor comprising:

(a)a sealed container having an inside and having an axial direction;

(b) a motor for producing a revolving movement;

(c) a crankshaft for receiving the revolving movement from the motor;

(d) an orbital mechanism for receiving the revolving movement from the crankshaft and for converting the revolving movement to an orbital movement;

(e) a compression mechanism for applying a suction pressure to the inside of the sealed container, the compression mechanism having a peripheral portion with a suction port and a center portion and comprising:

(i) a supporting member secured to the inside of the sealed container, the supporting member having a center portion with a discharge port at the center portion of the supporting member;

(ii) a first scroll disposed on the supporting member for movement in the axial direction and having a first scroll blade projecting toward the motor, the first scroll having a center portion with a communication port which communicates with the discharge port;

(iii) a frame disposed between the motor and the first scroll; and (iv) a second scroll supported by the frame and receiving the orbital movement from the orbital mechanism to cause relative movement between the first scroll and the second scroll, the second scroll having a second scroll blade which forms with the first scroll blade a compression chamber having a volume which decreases as the relative movement between the first scroll and the second scroll causes the compression chamber to move from the peripheral portion of the compression mechanism to the center portion of the compression mechanism;

wherein said compression chamber is moved by said relative movement from the peripheral portion of the compression mechanism, drawing a fluid through the suction port, toward the center portion of the compression mechanism leading to the discharge port, so as to reduce the volume of said compression chamber, thereby effecting a compression operation and discharging the fluid to said discharge port;

wherein the first scroll has a portion disposed around the communication port, the portion disposed around the communication port having formed thereon a pressure-receiving surface for receiving a back pressure of the fluid discharged to the discharge port so as to press said first scroll toward said second scroll;

wherein an annular seal portion is provided to form a seal between said first scroll and the supporting member around a region of communication between said communication port and said discharge port in such a manner as to satisfy a necessary annular sealing surface area, and a circumferential recess defining a space for catching wear powder resulting from wear of the annular seal portion is provided on a side lower in pressure than said annular seal portion; and wherein said compressor comprises a projection engaged in said recess in such a manner that a gap between said projection and said recess is larger than a gap between said first scroll and said supporting member.

* * * * *